United States Patent [19]

Perrin

[11] Patent Number: 4,990,015

[45] Date of Patent: Feb. 5, 1991

[54] PEN OR SIMILAR ARTICLE, WITH AN IMPROVED CLIP

[75] Inventor: Alain D. Perrin, Rueil-Malmaison, France

[73] Assignee: Cartier International B.V., Amsterdam, Netherlands

[21] Appl. No.: 528,073

[22] Filed: May 24, 1990

[30] Foreign Application Priority Data

May 29, 1989 [FR] France ..... 89 07007

[51] Int. Cl.[5] ..... B43K 25/00

[52] U.S. Cl. ..... 401/243; 24/11 R; 24/11 P

[58] Field of Search ..... 401/243; 24/11 R, 11 F, 24/11 P, 11 PP, 11 CC, 11 CT, 11 C, 11 HC

[56] References Cited

U.S. PATENT DOCUMENTS

| | | | |
|---|---|---|---|
| 2,423,948 | 7/1947 | Prince | 24/11 P |
| 2,538,294 | 1/1951 | Claret | 24/11 F |
| 2,691,805 | 10/1954 | Marshall . | |

FOREIGN PATENT DOCUMENTS

| | | | |
|---|---|---|---|
| 622776 | 3/1927 | France | 24/11 P |
| 2279568 | 2/1976 | France . | |
| 853896 | 11/1960 | United Kingdom | 24/11 P |

*Primary Examiner*—Richard J. Johnson

*Attorney, Agent, or Firm*—Cushman, Darby & Cushman

[57] ABSTRACT

The invention relates to a pen including a tubular body and a rigid fastening clip that extends longitudinally of the body and is pivotably movable with respect to the body, characterized in that the clip (6) is solidly attached in its upper portion (7) to at least one point of an elastic device (8, 9) accommodated in the body (1, 2) and immobilized with respect to it in the longitudinal and transverse directions.

10 Claims, 1 Drawing Sheet

PEN OR SIMILAR ARTICLE, WITH AN IMPROVED CLIP

The present invention relates to a pen or similar article, with an improved clip.

BACKGROUND OF THE INVENTION

The term "pen" in the context of the invention means any writing instrument, such as a fountain pen, ballpoint pen, mechanical pencil, felt-tip pen, or similar article including a tubular body and a rigid fastener clip that extends longitudinally of the body and is pivotably movable with respect to the body. The body in the present context may be the pen itself or a detachable cap.

Similar articles may be any articles that include a clip that in particular enables them to be attached, for instance to the pocket of an article of clothing.

Pen clips of known types, whether retractable or pivoting, are rigidly fastened to the body. If they are of the pivoting type, the clip works by its own elasticity, which has various disadvantages. In particular, it is difficult to make this clip adapt to different thicknesses of pockets in clothing.

On the other hand, known clips of both the retractable and the pivoting type have the disadvantage of including a complex, fragile mechanism both for fastening the clip to the body and for the elastic return of the clip toward the body.

Thus the known pivoting clips are generally articulated in the area of their upper portion on the body or on a piece connected to it, and for their elastic return toward the body they include a leaf spring that extends along the clip and is fastened in its lower portion to the vicinity of the free end of the clip, and in its upper portion to the body or to some piece connected to it.

In deluxe pens, for the sake of prestige and for esthetic reasons, the fastening and return mechanism, and in particular the leaf spring, must be especially reliable and must be invisible from the outside, so that as a result, the spring is typically accommodated inside the clip. This means that the clip has to be at least partly hollow, which lessens its rigidity and makes it fragile. Moreover, the clip is generally capable of relatively major lateral bottoming in the area of its free end, causing repeated strains on the clip, which results in damage to its fastening and return mechanism.

GENERAL DESCRIPTION OF THE INVENTION

The present invention proposes furnishing a pen that includes an improved fastening and elastic return mechanism of the clip, which in particular overcomes the disadvantages noted above, so that a solid, rigid clip can be used, the fastening and elastic return mechanism of which is entirely invisible.

The pen according to the invention is essentially characterized in that the clip is solidly attached in its upper portion, at least one point, to an elastic device accommodated in the body and immobilized with respect to it in the longitudinal and transverse directions. The elastic device comprises two superimposed spring leaves extending longitudinally of the body, the inner one of which is immobilized with respect to the body in the longitudinal direction and the other outer one of which is in contact with the clip over part of its length and includes an upper end portion extending outwardly, the two leaves being joined to one another and to the clip via a fastener such as a screw. Preferably, the upper end portion, extending outwardly, of the outer spring leaf is also joined to the clip by a fastener such as a screw.

In a preferred embodiment, the longitudinal positioning of the clip is obtained by the engagement of bent lateral tabs of the inner spring leaf with an annular groove section of the body.

With lateral tabs of great length, it is also possible to assure transverse positioning of the inner leaf and hence of the clip.

However, in a preferred embodiment, this transverse positioning of the clip is obtained by engagement of the longitudinal ends of the inner spring leaf with aligned upper and lower longitudinal grooves made in the inner wall of the body and/or in the outer wall of a sleeve that is disposed inside the body and is solidly attached to it.

In a particular embodiment, the inner spring leaf has a length greater than the outer spring leaf and includes, beyond the upper end of the outer spring leaf, an upper end portion extending inwardly and positioned in the upper longitudinal groove.

Advantageously, in this embodiment, the lower ends of the two spring leaves coincide, and the lower end portions of the two leaves are accommodated in the lower longitudinal groove of the aforementioned sleeve. These lower end portions of the two spring leaves are preferably made such that they extend slightly inwardly.

In the case where an inner sleeve is provided, and to enable easy assembly of the clip, the tubular body is made in two parts, an upper part and a lower part, which are capable of being placed around the sleeve; the plane of separation of the two parts of the body may be horizontal but is preferably inclined by an angle of between 30 and 60° with respect to the longitudinal axis of the pen, and preferably approximately 45°.

DETAILED DESCRIPTION OF THE INVENTION

For better comprehension of the invention, a solely exemplary and non-limiting embodiment will be described below, in conjunction with the drawings, in which.

Figure 1:
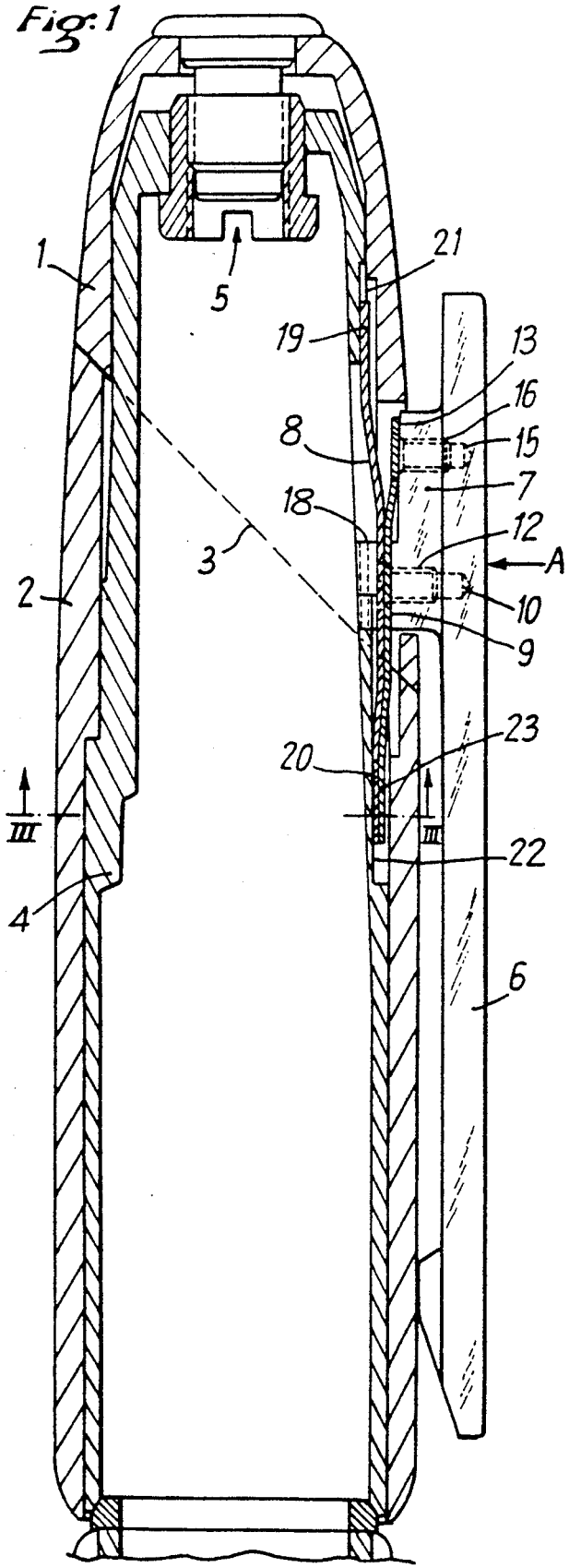
FIG. 1 is a sectional view of a pen cap according to the invention.

In the drawing, a pen cap has been shown that includes a tubular body made in two parts, an upper part 1 and a lower part 2, which are joined along a parting line 3, which in the example shown is inclined by essentially 45° with respect to the longitudinal axis of the pen.

A tubular sleeve 4 is installed inside the body 1, 2, joined to the upper part 1 of the body by a fastening mechanism such as a dowel and screw mechanism 5 of a known type.

The pen according to the invention includes a rigid, solid clip 6, extending parallel to the longitudinal axis of the pen and including a head portion 7, extending inwardly, in the vicinity of its upper end.

To attach the clip 6 to the body, the invention provides an elastic device comprising two superimposed spring leaves, made of a flexible metal, such as spring steel, these being an inner leaf 8 and an outer leaf 9.

The inner leaf 8 has a length greater than the outer leaf 9.

As can be seen in FIG. 1, the leaves 8 and 9 press against one another over part of their length and are joined together at the head 7 of the clip via a device such as a fastening screw 10 passing through aligned openings 11 and 11' in the leaves 8 and 9 and through a bore 12 in the head 7 of the clip. The openings 11 and 11' are arranged such that the head of the screw 10 is accommodated in the thickness of the two superimposed leaves 8 and 9.

As best seen in FIG. 1, the outer leaf 9 has an outwardly extending portion 13 at its upper end, in which there is an opening 14 for the passage of a fastener such as a screw 15 that engages a bore 16 made in the head 7 of the clip above the bore 12.

Thus the clip 6 is fastened at the level of its head 7 at two points to the outer leaf 9, which in turn is joined to the inner leaf 8 by the screw 10.

Figure 2:
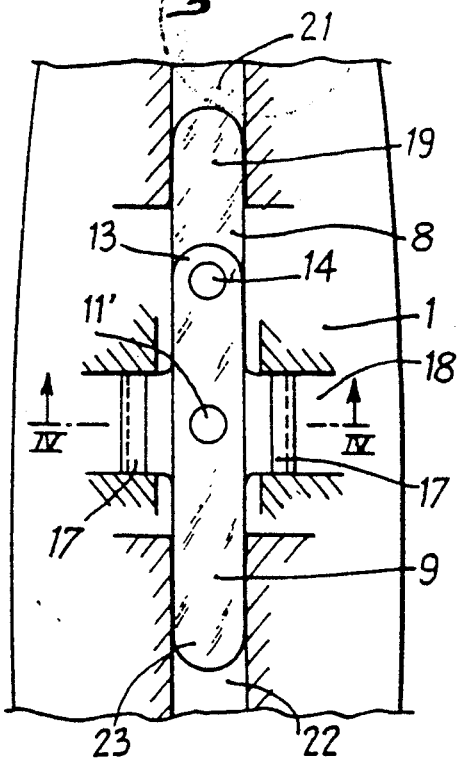
FIG. 2 is a fragmentary, schematic view substantially in the direction of the arrow A in FIG. 1, with the clip omitted for the sake of clarity.
Figure 3:
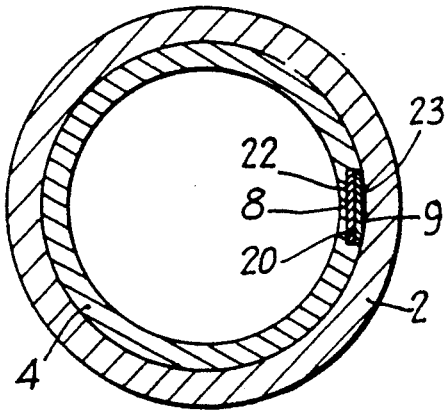
FIG. 3 is a sectional view taken along the line III—III of FIG. 1.
Figure 4:
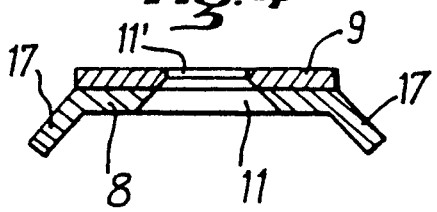
FIG. 4 is a sectional view taken along the line IV—IV of FIG. 2.

As best seen in FIGS. 2 and 4, this inner leaf 8 includes two folded lateral tabs 17 at the level of its portion that includes the hole 11; the leaf 8 is mounted, in the zone including the folded tabs 17, in an annular groove section 18 of the outer wall of the upper part 1 of the body.

The upper end portion 19 and the lower end portion 20 of the inner spring leaf 8, which are made such that they extend inwardly with respect to the portion of the inner leaf 8 contacting the outer leaf 9 in the zone where they are fastened in common, are engaged and retained laterally in longitudinal grooves, that is, grooves parallel to the axis of the pen, namely an upper groove 21 and a lower groove 22, which are made in the outer wall of the sleeve 4.

In the embodiment shown, the two leaves 8 and 9 coincide at the level of their lower portion, such that the lower portion 23 of the leaf 9 is likewise accommodated in the lower groove 22 of the sleeve 4.

Thus the elastic device embodied by the two spring leaves 8 and 9 is immobilized in both the longitudinal and transverse directions by engagement of the corresponding portions of the spring leaves 8 and 9 in the grooves 18, 21 and 22.

When the pen provided with the clip according to the invention is placed in the pocket of an article of clothing, the free lower end of the clip 6 is spaced apart, by the thickness of the cloth, from the lower part 2 of the body, because the head 7 of the clip is arranged to pivot counter to the action of the spring leaves 8 and 9. Because of the longitudinal and transverse immobilization of the elastic assembly comprising the leaves 8 and 9, the clip pivots in a vertical plane, without lateral bottoming.

When the pen is taken out of the pocket, the effect of the elastic return of the spring leaves 8 and 9 returns the free lower end of the clip to the position shown in FIG. 1. This position is also effected without any lateral bottoming at all.

As can be seen particularly in FIG. 1, in the zone intended for mounting the clip, the two parts 1 and 2 of the body and the sleeve 4 all have corresponding recesses for installing the spring leaves 8 and 9 and to enable rocking of the head 7 of the clip in the direction of the body.

Mounting is done simply by fastening the two leaves 8 and 9 to a clip with the aid of screws 10 and 15, mounting the thus-assembled set on a sleeve 4, and causing the ends 19 and 20 of the spring leaf 8 to engage the corresponding longitudinal grooves 21 and 22 of the sleeve, then putting the two parts of the body 1 and 2 in place on the sleeve from above and below, respectively, and fastening them; the upper part 1 of the body is installed such that the bent tabs 17 of the spring leaf 8 engage the annular groove section 18 of the body.

Although the invention has been described in conjunction with a particular embodiment, it is to be understood that it is in no way limited to this, and that variant embodiments are possible and various modifications may be made without departing from the spirit and scope of the invention.

In particular, the two parts 1 and 2 of the body need not necessarily be assembled along a plane 3 that is oblique with respect to the longitudinal axis of the pen.

All that is necessary in this respect is that in the zone of the body facing the clip, the separation plane between the upper part of the body and the lower part of the body be below the lower end of the head 7 of the clip.

Finally, as already noted, the clip need not be provided only on the cap; it can instead be on the pen itself. In that case, the body 1, 2 is the body of the pen, and the part 1 comprises its upper end.

I claim:

1. A pen including a tubular body and a rigid fastening clip that extends longitudinally of the body and is movable by pivoting with respect to the body, characterized in that the clip (6) is solidly attached in its upper portion (7) to at least one point of an elastic device (8, 9) accommodated in said body (1, 2) and immobilized with respect thereto in the longitudinal and transverse directions, said elastic device comprising two superimposed spring leaves (8, 9) extending longitudinally of the body, the inner (8) of which leaves is immobilized with respect to said body in the longitudinal direction and the other, outer (9) of which leaves is in contact over part of its length with the clip and includes an upper end portion (13) extending outwardly, the two leaves (8, 9) being joined to one another and to the clip by means of a fastener (10).

2. A pen as defined by claim 1, characterized in that the upper end portion (13), extending outwardly, of the outer spring leaf (9) is also joined to the clip by a fastener (15).

3. A pen as defined by claim 1, characterized in that for the longitudinal positioning of the clip, the inner spring leaf (8) includes bent lateral tabs (17) that engage an annular groove section (18) of the body.

4. A pen as defined by claim 1, characterized in that for the transverse positioning of the clip, the longitudinal ends (19, 20) of the inner spring leaf (8) engage aligned upper and lower longitudinal grooves (21, 22, respectively), made in the inner wall of the body and/or in the outer wall of a sleeve (4) that is disposed inside the body (1, 2) and is solidly attached to it.

5. A pen as defined by claim 4, characterized in that the inner spring leaf (8) has a length greater than the outer spring leaf (9) and includes, beyond the upper end (13) of the outer spring leaf, an upper end portion (19) extending inwardly and positioned in the upper longitudinal groove (21).

6. A pen as defined by claim 4, characterized in that the lower ends of the two spring leaves coincide, and the lower end portions (20, 23) of the two leaves are accommodated in said lower longitudinal groove (22).

7. A pen as defined by claim 6, characterized in that the lower end portions (20, 23) of the two spring leaves (8, 9) are made such that they extend slightly inwardly.

8. A pen as defined by claim 1, characterized in that the body is made in two parts, an upper part (1) and a lower part (2).

9. A pen as defined by claim 8, characterized in that the plane of separation of the two parts of the body is inclined by an angle of between 30° and 60°, with respect to the longitudinal axis of the pen.

10. A pen as defined by claim 8, characterized in that the plane of separation of the two parts of the body is inclined by an angle of 45° with respect to the longitudinal axis of the pen.

* * * * *